US005832342A

United States Patent [19]

Hazama et al.

[11] Patent Number: 5,832,342

[45] Date of Patent: Nov. 3, 1998

[54] IMAGE FORMING MACHINE WITH A CONTACT TYPE DEVELOPING DEVICE

[75] Inventors: Hiroyuki Hazama; Hiroaki Shiba; Toru Ueno, all of Osaka, Japan

[73] Assignee: Mita Industrial Co., Ltd., Osaka, Japan

[21] Appl. No.: 892,100

[22] Filed: Jul. 14, 1997

[30] Foreign Application Priority Data

Jul. 25, 1996 [JP] Japan ..... 8-195142

[51] Int. Cl.[6] ..... G03G 15/08

[52] U.S. Cl. ..... 399/107; 399/116; 399/279

[58] Field of Search ..... 399/149, 150, 399/111, 113, 116, 347, 127, 159, 107, 119, 279; 347/140, 153, 158

[56] References Cited

U.S. PATENT DOCUMENTS 4,851,865 7/1989 Ehara et al. ..... 347/140

5,300,990 4/1994 Thompson ..... 399/240

FOREIGN PATENT DOCUMENTS 5-88427 4/1993 Japan .

9-22155 1/1997 Japan .

*Primary Examiner*—Arthur T. Grimley

*Assistant Examiner*—Quana Grainger

*Attorney, Agent, or Firm*—Beveridge, DeGrandi, Weilacher & Young, L.L.P.

[57] ABSTRACT

An image forming machine including a single layer dispersion type photoconductor drum, a charging device for charging the surface of the photoconductor drum to a specific polarity, and a developing roller for conveying a developer to the surface of the photoconductor drum having a latent electrostatic image formed thereon. The photoconductor drum and the developing roller are adapted to contact each other at their surfaces and to be rotationally driven in reverse directions. The photoconductor drum has a diameter set at 10 to 20 mm, while the developing roller has a diameter set at 90 to 110% of the diameter of the photoconductor drum.

1 Claim, 2 Drawing Sheets

IMAGE FORMING MACHINE WITH A CONTACT TYPE DEVELOPING DEVICE

FIELD OF THE INVENTION

The present invention relates to an image forming machine such as a copier, a printer or a facsimile.

DESCRIPTION OF THE PRIOR ART

In an image forming machine such as a copier, a printer or a facsimile, a latent electrostatic image based on image data is formed on the surface of a photoconductor drum by, for example, a laser scan unit. Around the photoconductor drum, a developing unit is provided adjacently. This developing unit converts the latent electrostatic image on the surface of the photoconductor drum into a visible toner image.

The photoconductor drum may have a photosensitive layer of an organic photoconductor (OPC) or the like formed on the outer peripheral surface of a cylindrical drum stock of an electrically conductive metal such as aluminum. As the photosensitive layer, a laminate type photoconductor is well known which comprises a charge carrier generation layer (CGL) and a charge carrier transport layer (CTL) functionally separated from each other and structurally laminated one on the other. This laminate type photoconductor comprises CTL about 20 to 30 $\mu$m thick laminated on the top of CGL several micrometers thick.

With this type of photoconductor, light projected by the laser scan unit or the like is absorbed by the CGL to be converted into charge carriers. The charge carriers generated by the CGL are injected into the CTL, where they move and neutralize the surface charges to form a latent electrostatic image on the surface. Such a laminate type photoconductor is produced by laminating a plurality of layers, and requires a complicated manufacturing process.

In contrast, there is a photoconductor drum of a single layer dispersion type which uses a photoconductor comprising particles of a charge carrier generation material (CGM) dispersed in a photosensitive layer containing a charge carrier transport material (CTM). This single layer dispersion type photoconductor drum has the advantage of a simplified manufacturing process. However, it poses the problems that CGM particles expose themselves on the surface, roughening the surface of the photoconductor drum, and this surface can be deteriorated by ozone that a charging device generates.

The developing unit provided adjacent the photoconductor drum is provided with a developing roller for transferring a developer to the surface of the photoconductor drum to form a toner image. Among image forming machines including the developing roller of the developing unit and the photoconductor drum are those involving contact development in which the developing roller and the photoconductor drum make contact, and those applying noncontact development in which the developing roller and the photoconductor drum make no contact. Image forming machines involving noncontact development need a cleaning mechanism, such as a cleaning blade, which contacts the surface of the photoconductor drum in order to remove a toner that has remained on this surface after the transfer of the toner image to a recording sheet. With image forming machines involving contact development, on the other hand, the remaining toner can be recovered by the developing roller into the developing unit so as to be reused, and thus the cleaning mechanism can be obviated. Hence, the machine can be downsized.

To achieve downsizing of such an image forming machine, an idea would be to decrease the diameter of the photoconductor drum. Furthermore, the use of an image forming machine applying contact development that can obviate the cleaning mechanism enables the entire machine to be downsized.

The charged region of the photoconductor drum is exposed to ozone generated by corona discharge. In the photoconductor drum of a small diameter, the charged region is also made small in size in agreement with the small diameter. Compared with a large-diameter photoconductor drum, however, the share of the charged region in the area of the photoconductor drum increases. When a small-diameter photoconductor drum is used, therefore, the entire surface of the photoconductor drum can be easily exposed to an ozone atmosphere in comparison with a large-diameter photoconductor drum. Since the surface area of the photoconductor drum is small, moreover, the image of a single sheet is formed upon a plurality of rotations. Partly because of this, the deterioration of the photoconductor drum by ozone occurs after a relatively short period of operation. As a result, the resulting image may become blurred. Particularly, for a single layer dispersion type photoconductor drum having CGM particles exposed on the surface, ozone-associated deterioration of the surface constitutes a problem. An image forming machine relying on contact development poses the problem that a downsized photoconductor drum reduces the width of the nip between the photoconductor drum and the developing roller.

When contact development is applied, it is important that the ozone-deteriorated surface of the photoconductor drum is moderately shaved with the developing roller for its activation. However, much shaving of the photoconductor by the developing roller causes the photoconductor drum to reach its working limit early.

SUMMARY OF THE INVENTION

The object of the present invention is to provide an image forming machine using a single layer dispersion type photoconductor drum and involving contact development, in which the photoconductor drum is made small in diameter to downsize the image forming machine, and by which to obtain a stable image for a long period of time while dealing with the deterioration of the photoconductor drum by ozone generated by corona discharge of a charging device.

We, the inventors of this invention, have attempted to achieve predetermined durability of the photoconductor drum while activating it, by moderately shaving its surface, deteriorated by ozone, in an image forming machine which applies contact development to the photoconductor drum made small in diameter to downsize the image forming machine. For this purpose, we made in-depth studies while conducting experiments focused on the direction of rotation of the photoconductor drum and the developing roller which make contact with each other, as well as the diameters of the photoconductor drum and the developing roller. As a result, we have designed the photoconductor drum and the developing roller to rotate in reverse directions so that the difference between their relative speeds at the nip will not become too large, and we have set the diameters of the photoconductor drum and the developing roller to be in a predetermined relationship so that an appropriate nip width will be obtained between them.

That is, the present invention provides an image forming machine comprising a single layer dispersion type photoconductor drum disposed rotatably and passing through a charging zone, a latent electrostatic image forming zone, and a developing zone sequentially; a charging device disposed in the charging zone to charge the surface of the photoconductor drum to a specific polarity; and a developing roller disposed in the developing zone to convey a developer to the surface of the photoconductor drum having a latent electrostatic image formed in the latent electrostatic image forming zone; wherein the photoconductor drum and the developing roller are adapted to contact each other at their surfaces and to be rotationally driven in reverse directions; and the photoconductor drum has a diameter set at 10 to 20 mm, while the developing roller has a diameter set at 90 to 110% of the diameter of the photoconductor drum.

DETAILED DESCRIPTION OF THE PREFERRED EMBODIMENTS

An embodiment of an image forming machine constructed in accordance with the present invention will now be described in detail with reference to the accompanying drawings. In the illustrated embodiment, an image forming machine constructed in accordance with the present invention is taken as an example for explanation.

Figure 1:
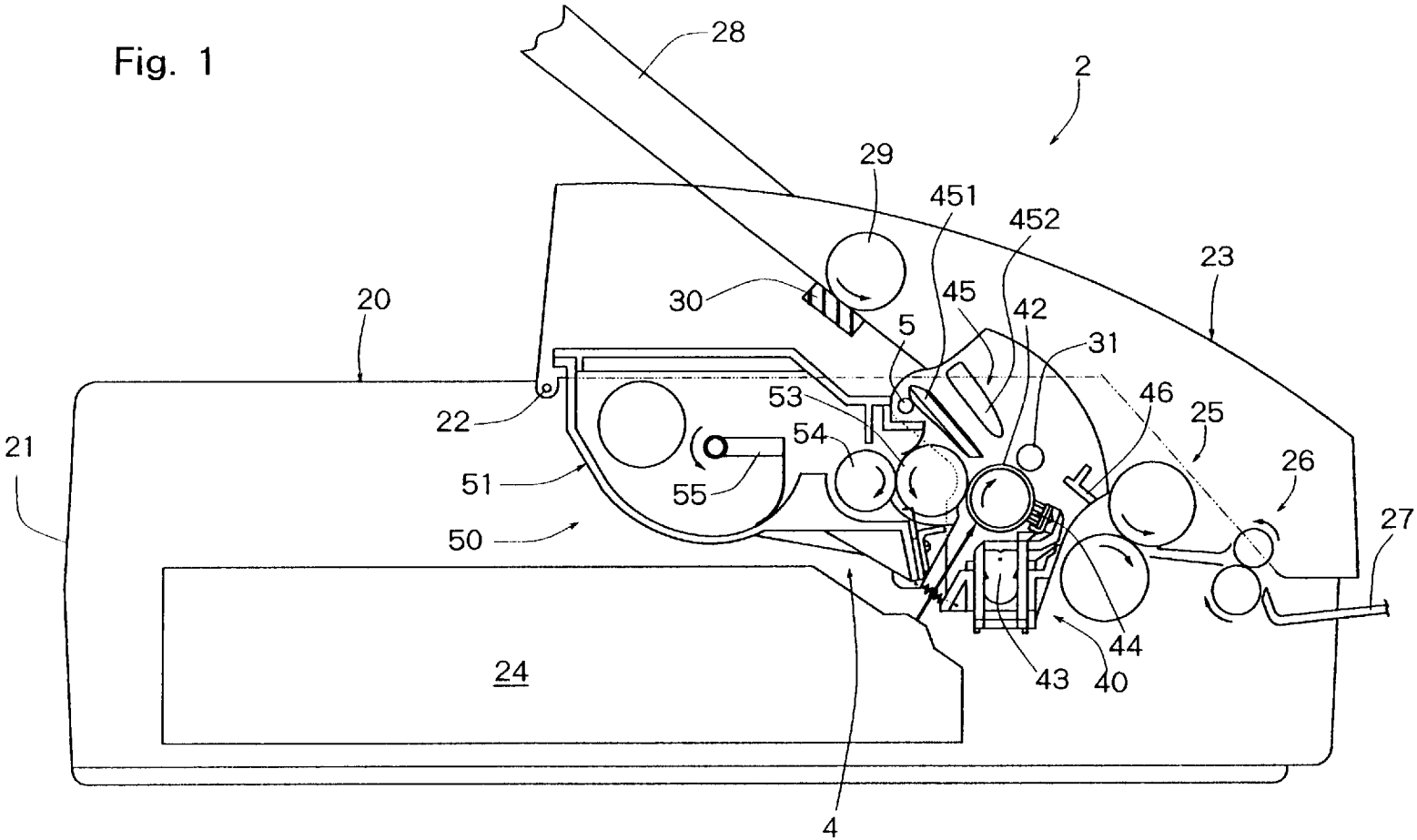
FIG. 1 is a front view schematically showing a printer, an embodiment of an image forming machine constructed in accordance with the present invention.

FIG. 1 schematically shows a printer 2, an embodiment of an image forming machine constructed in accordance with the present invention. The printer 2 in this embodiment is a small, slow speed laser printer for use as a printing machine for a word processor or the like, and has a machine housing 20 molded from a plastic material. The machine housing 20 includes a box-shaped housing body 21 open at the top, and a cover 23 pivotably mounted on a shaft 22 disposed in an upper part of the housing body 21. In a nearly central part of the so constructed machine housing 20, a process unit is mounted detachably.

Figure 2:
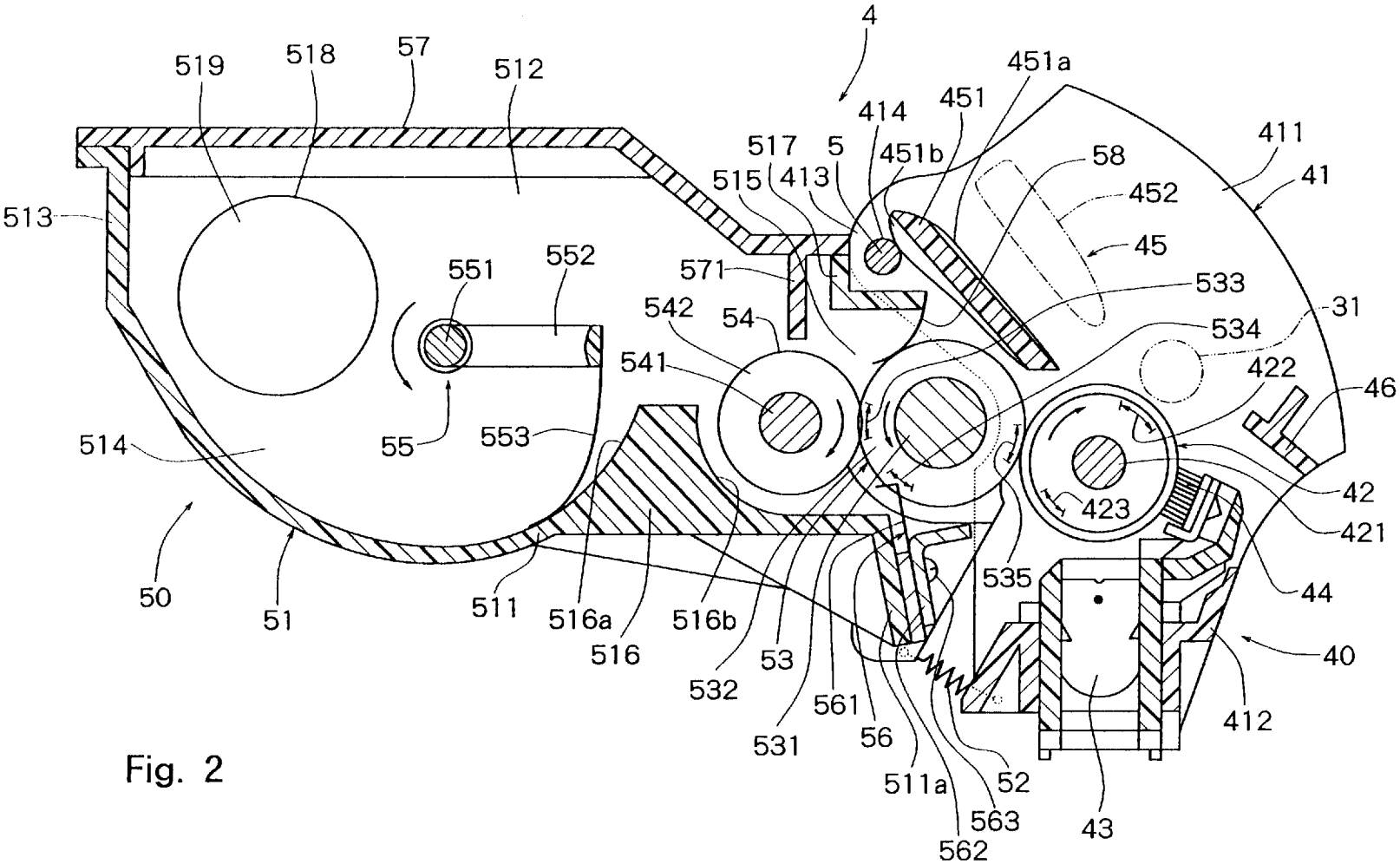
FIG. 2 is a sectional view of the printer shown in FIG. 1.

The process unit 4, as shown in FIG. 2, has a photoconductor unit 40, and a developing unit 50 pivotably supported by the photoconductor unit 40 via a support shaft 5. The photoconductor unit 40 has a photoconductor support means 41, and the photoconductor support means 41 has a pair of side wall members 411 (only a rear side wall member is shown in FIG. 2) placed with spacing in a front-to-back direction (a direction perpendicular to the sheet face of the drawing), and a connecting member 412 which connects together lower parts of the pair of side wall members 411. The so constructed photoconductor support means 41 is integrally molded from a plastic material. In upper end parts, on the developing unit 50 side, of the pair of side wall members 411 constituting the photoconductor support means 41, support portions 413 having mounting holes 414 are provided. These mounting holes 414 provided in the support portions 413 are fitted with the support shaft 5 which is disposed in a development housing (to be described later on) of the developing unit 50 and which is composed of a metallic bar stock. Thereby, the photoconductor unit 40 and the developing unit 50 are supported so as to be pivotable relative to each other.

The photoconductor unit 40 has a photoconductor drum 42 having a photosensitive layer formed on its peripheral surface. This photoconductor drum 42 has its rotating shaft 421 supported rotatably by the pair of side wall members 411 constituting the photoconductor support means 41, and rotationally driven by a drive means (not shown) in a direction indicated by an arrow, namely, from below to above in a developing zone, the site of contact (nip) between the photoconductor drum 42 and a developing roller (to be described later on) of the developing unit 50. In the connecting member 412 of the photoconductor support means 41, a charging corona discharger 43 is disposed in a charging zone opposed to a lower peripheral surface of the photoconductor drum 42. Upstream from the charging corona discharger 43 in the direction of rotation of the photoconductor drum 42, a paper dust removing brush 44 is disposed for making contact with the peripheral surface of the photoconductor drum 42.

The photoconductor drum 42 has a single layer dispersion type organic photoconductor 30 $\mu$m thick which was prepared in the following manner:

| | |
|---|---|
| Metal-free phthalocyanine (charge carrier generation material) | 5 parts by weight |
| N,N'-bis(O,P-dimethylphenyl)N,N'-diphenylbenzidine (hole transport material) | 40 parts by weight |
| 3,3',5,5'-tetraphenyldiphenoquinone (electron transport material) | 40 parts by weight |
| Polycarbonate (binder resin) | 100 parts by weight |
| Dichloromethane (solvent) | 800 parts by weight |

The above components were mixed and dispersed by a ball mill. The resulting coating fluid was coated on a drum stock of aluminum by dip coating. Then, the coating was dried in hot air for 60 minutes at 60° C. to form the layer on the drum.

Between the pair of side wall members 411 constituting the photoconductor support means 41, a lower guide plate 451 is disposed which constitutes one component of a pre-transfer guide plate pair 45 that guides a transfer sheet fed from obliquely upper left in FIG. 2 toward a transfer zone 422 on the peripheral surface of the photoconductor drum 42. The lower guide plate 451 is molded integrally with the pair of side wall members 411. On the upper surface of the lower guide plate 451, a plurality of guide ribs 451*a* are integrally molded with spacing in a longitudinal direction (a direction perpendicular to the sheet face of FIG. 2). The lower guide plate 451 also has on its lower surface a plurality of reinforcing ribs 451*b* formed with spacing in the longitudinal direction (the direction perpendicular to the sheet face of FIG. 2) so as to contact the support shaft 5. Thus, even if a pressing force acts on the upper surface of the lower guide plate 451 in an attempt to deflect the lower guide plate 451, the reinforcing ribs 451*b* make contact with the support shaft 5, thus preventing a deflection. The lower guide plate 451 also functions as a connecting member which connects together upper parts of the pair of side wall members 411 constituting the photoconductor support means 41, thereby improving the rigidity and strength of the photoconductor support means 41. In the illustrated embodiment, moreover, the lower guide plate 451 is molded integrally with the pair of side wall members 411, and thus can keep a highly precise positional relationship with the photoconductor drum 42 rotatably supported on the pair of side wall members 411.

Between the pair of side wall members 411 constituting the photoconductor support means 41, a post-transfer guide plate 46 is displaced which guides a transfer sheet, having an image transferred thereto in the transfer zone 422, to a fixing means (to be described later on). The post-transfer guide plate 46 is molded integrally with the pair of side wall members 411. Thus, the post-transfer guide plate 46 functions as a connecting member which connects together the pair of side wall members 411 constituting the photoconductor support means 41, thereby improving the rigidity and strength of the photoconductor support means 41.

A developing unit 50 as a latent electrostatic image developing device is described. The developing unit 50 in the illustrated embodiment has a development housing 51 accommodating a developer comprising a one-component toner. The development housing 51 is composed of a bottom wall 511, a front side wall 512 and a rear side wall 512 (only the rear side wall is shown in FIG. 2) erected upright from the front and rear ends of the bottom wall 511 (the ends in the direction perpendicular to the sheet face of FIG. 2), and a left side wall 513. These walls are integrally molded from a plastic material, defining an agitation chamber 514 and a development chamber 515. On the bottom wall 511 constituting the development housing 51, a partition wall 516 provided in the front-to-back direction (the direction perpendicular to the sheet face in FIG. 2) is integrally molded between the agitation chamber 514 and the development chamber 515. The left and right surfaces of the partition wall 516 are formed as arcuate guide surfaces 516*a* and 516*b*. Between the front and rear side walls 512 constituting the development housing 51, a connecting member 517 disposed in an upper part on the development chamber 515 side is provided integrally with the front and rear side walls 512. In the rear side wall 512 constituting the development housing 51, a toner supply hole 518 is formed. The toner supply hole 518 is fitted with a cap 519. In an upper end part, on the development chamber 515 side, of the so constructed development housing 51, the support shaft 5 is disposed so as to pass through the front and rear side walls 512. By fitting both end parts of the support shaft 5 into the mounting holes 414 provided in the support portions 413 of the pair of side wall members 411 constituting the photoconductor support means 41 of the photoconductor unit 40, the photoconductor unit 40 and the developing unit 50 are supported so as to be pivotable relative to each other. Between a front end side of a lower end part of the photoconductor support means 41 of the photoconductor unit 40 and a rear end side of a lower end part of the development housing 51, coiled springs 52 are interposed as spring means. These coiled springs 52 urge the photoconductor support means 41 and the development housing 51 toward each other about the support shaft 5. The development housing 51 is open upwards and rightwards, i.e., on the photoconductor unit 40 side.

Inside the development housing 51, a developing roller 53, a makeup roller 54, an agitating means 55 and a developer regulating means 56 are disposed.

The developing roller 53 is disposed in the development chamber 515 of the development housing 51, and includes a rotating shaft 531 mounted rotatably on the front and rear side walls 512 constituting the development housing 51, and a solid synthetic rubber roller 532 secured to the outer peripheral surface of the rotating shaft 531. The rotating shaft 531 may be formed of a suitable metallic material such as stainless steel. The solid synthetic rubber roller 532 is composed of a relatively flexible and conductive material, e.g., conductive solid synthetic rubber such as urethane rubber. In the illustrated embodiment, the surface roughness of the peripheral surface of the solid synthetic rubber roller 532, i.e., the 10-point average roughness Rz defined in JIS B 0601, is set at 5.0 to 12.0. The volume resistivity of the solid synthetic rubber roller 532 is set at about $10^4$ to $10^9$ ω·cm. The roller hardness of the solid synthetic rubber roller 532 is set at an Asker C hardness of 60 to 80 in the illustrated embodiment. The so constructed roller 532 of the developing roller 53 is exposed through a right-hand opening formed in the development housing 51, and positioned opposite the photoconductor drum 42. The peripheral surface of the roller 532 constituting the developing roller 53 is pressed against the peripheral surface of the photoconductor drum 42 in the developing zone. At the nip in this pressed condition, the peripheral surface of the roller 532 is compressed slightly elastically. The rotating shaft 531 of the developing roller 53 is rotationally driven by a drive means (not shown) in the direction of an arrow, i.e., from below to above in the developing zone, the site of contact between the roller 532 and the photoconductor drum 42. In accordance with this rotation of the rotating shaft 531, the roller 532 is also rotationally driven in the direction of the arrow, namely, in a direction reverse to the direction of rotation of the photoconductor drum 42, so that the peripheral surface of the roller 532 is sequentially moved through a developer holding zone 533, a developer regulating zone 534, and a developing zone 535. In the illustrated embodiment, a constant voltage of 300 V is applied to the rotating shaft 531 of the developing roller 53.

The makeup roller 54 is disposed parallel to the developing roller 53 inside the development chamber 515 of the development housing 51. The makeup roller 54 includes a rotating shaft 541 mounted rotatably on the front and rear side walls 512 constituting the development housing 51, and a roller 542 secured to the outer peripheral surface of the rotating shaft 541. The rotating shaft 541, like the rotating shaft 531 of the developing roller 53, maybe formed of a suitable metallic material, such as stainless steel. The roller 542 is composed of a foam such as silicone foam or urethane foam. The roller 542 is pressed against the roller 532 of the developing roller 53 in the developer holding zone 533, the nip between the roller 542 and the developing roller 53. The hardness of the foam constituting the roller 542 of the makeup roller 54 is much smaller than the hardness of the roller 532 constituting the developing roller 53 (for example, an Asker C hardness of about 35), and it is desirable that by being pressed against the roller 532 of the developing roller 53, the roller 542 be elastically compressed in the nip region by about 0.1 to 0.6 mm. The roller 542 also has conductivity, and its volume resistivity is set at about $10^2$ to $10^6$ ω·cm. The rotating shaft 541 of the makeup roller 54 is rotationally driven by a drive means (not shown) in the direction of an arrow, i.e., from above to below in the developer holding zone 533, the nip between the roller 542 and the roller 532 of the developing roller 53. In accordance with this rotation of the rotating shaft 541, the roller 542 is also rotationally driven in the direction of the arrow. In the illustrated embodiment, a constant voltage of 450 V, a higher voltage than the voltage applied to the developing roller 53, is applied to the rotating shaft 541 of the makeup roller 54.

In the agitation chamber 514 of the development housing 51, an agitating means 55 is disposed. The agitating means 55 is disposed parallel to the makeup roller 54, and includes a rotating shaft 551 mounted rotatably on the front and rear side walls 512 constituting the development housing 51, an agitating member 552 fixed to the rotating shaft 551, and an elastic agitating sheet member 553 mounted to the agitating member 552. The agitating member 552 is formed of a plastic material, and has a plurality of openings in the longitudinal direction (the direction perpendicular to the sheet face of FIG. 2). The agitating sheet member 553 is formed of a flexible, elastic material, such as polyethylene terephthalate (PETP), and is secured by an adhesive or the like to the front edge of the agitating member 552. The so constructed agitating means 55 is rotationally driven continuously by a drive means (not shown) in the direction of an arrow in FIG. 2.

The developer regulating means 56 has a flexible, elastic blade 561 to be pressed against the peripheral surface of the roller 532 constituting the developing roller 53. The blade 561 is composed of, say, a stainless steel plate or a spring steel plate about 0.1 to 0.2 mm thick, and has nearly the same longitudinal dimension as the length of the roller 532 constituting the developing roller 53. The blade 561 has a base end part mounted on a blade mounting portion 511*a* provided at the open end, on the photoconductor unit 40 side, of the bottom wall 511 constituting the development housing 51. That is, the base end part of the blade 561 is sandwiched between the blade mounting portion 511*a* and a press plate 562, and is fixed thereto by means of a machine screw 563. A front end part of the blade 561 is bent, and this bend is pressed against the peripheral surface of the roller 532 constituting the developing roller 53 in the developer regulating zone 534.

On the development housing 51, a closure 57 is mounted which covers the open top of the development housing 51. The closure 57 is composed of a plastic material, and is secured by an adhesive to the top surfaces of the front and rear side walls 512, the left side wall 513 and the connecting member 517 that constitute the development housing 51. On the inner surface of the closure 57, a regulating portion 571 is integrally molded which extends in the front-to-back direction (the direction perpendicular to the sheet face of FIG. 2) at a position opposed to the makeup roller 54, and which protrudes on the development chamber 515 side. Between the lower end of the regulating portion 571 and the outer peripheral surface of the roller 542 constituting the makeup roller 54, a predetermined spacing is provided. In the illustrated embodiment, the connecting member 517 constituting the development housing 51 is mounted with a sheet-like seal member 58. The sheet-like seal member 58 is composed of a flexible, elastic sheet member of, say, polyethylene terephthalate (PETP), and has nearly the same length as the axial length of the roller 532 constituting the developing roller 53. The sheet-like seal member 58 has one end part secured to the connecting member 517 by a securing means such as an adhesive, and has the other end part curved and elastically contacted with the peripheral surface of the roller 532 constituting the developing roller 53. The so constructed sheet-like seal member 58 prevents a scatter of the developer from the opening, on the photoconductor unit 40 side, of the development housing 51 in cooperation with the blade 561 of the developer regulating means 56.

The so constructed process unit 4 is mounted detachably on the machine housing 20 of the printer 2, as shown in FIG. 1. That is, the cover 23 constituting the machine housing 20 of the printer 2 is turned about the shaft 22 counterclockwise in FIG. 1, whereby the top of the housing body 21 constituting the machine housing 20 is opened. Then, the process unit 4 is mounted inside the housing body 21 from above. Inside the housing body 21, a positioning means (not shown) capable of placing the photoconductor unit 40 of the process unit 4 at a predetermined position is provided. After the process unit 4 is mounted inside the housing body 21 of the machine housing 20, the cover 22 is turned about the shaft 22 clockwise in FIG. 1 to close the top of the housing body 21.

As shown in FIG. 1, a laser unit 24 is disposed in a lower part of the housing body 21 constituting the machine housing 20 of the printer 2. This laser unit 24 throws laser light, corresponding to print data from, say, a word processor connected to the printer 2, upon the photosensitive layer of the photoconductor drum 42 in an exposure zone 423 of the process unit 4, thereby forming a latent electrostatic image. In the housing body 21 constituting the machine housing 20 of the printer 2, a fixing roller pair 25 is disposed downstream from the post-transfer guide plate 46. Downstream from the fixing roller pair 25, a discharge roller pair 26 is disposed. Furthermore, a copy receiving or discharge tray 27 is disposed downstream from the discharge roller pair 26.

On the cover 23 constituting the machine housing 20 of the printer 2, a feed tray 28 for bearing a transfer sheet is disposed at an upper left part in FIG. 1. Downstream from the feed tray 28, a feed roller 29 is disposed. This feed roller 29 is rotationally driven by a drive means (not shown) in the direction of an arrow in FIG. 1. Opposite the feed roller 29, a friction pad 30 is disposed for sheet separation. In the transfer zone 422, a noncontact transfer roller 31 is disposed opposite the photoconductor drum 42. The transfer roller 31 is formed of a conductive urethane foam, and rotatably supported on the cover 23. The transfer roller 31 has opposite end parts mounted with collars (not shown) which are composed of an insulating material, such as synthetic resin, and each of which has a larger outside diameter than the diameter of the transfer roller 31. These collars are disposed in contact with the peripheral surface of the photoconductor drum 42. Thus, the transfer roller 31 is caused to follow the rotation of the photoconductor drum 42 while slipping. The clearance between the peripheral surface of the transfer roller 31 and the peripheral surface of the photoconductor drum 42 is set at about 0.5 mm. A constant voltage of, say, 10 $\mu$A is applied to the so constructed transfer roller 31. On the cover 23, an upper guide plate 452 constituting the other component of the pre-transfer guide plate pair 45 is disposed.

The printer 2 in the illustrated embodiment is constructed as described above. Its actions will be described below.

Based on a print command from a word processor or the like (not shown), the above-described members start operation, and the photosensitive layer on the surface of the photoconductor drum 42 is charged substantially and uniformly to a specific polarity by the charging corona discharger 43. Then, the laser unit 24 throws laser light, corresponding to the print data from the word processor or the like, upon the surface of the charged photosensitive layer of the photoconductor drum 42, thereby forming a latent electrostatic image there. The latent electrostatic image formed on the photosensitive layer of the photoconductor drum 42 is developed to a toner image by the developing action of the developing unit 50. The developing action of the developing unit 50 will be described in detail later on. Transfer sheets laid on the feed tray 28 are fed one by one by the action of the feed roller 29 and the friction pad 30. The fed transfer sheet is guided by the pre-transfer guide plate pair 45, and conveyed to the site between the photoconductor drum 42 and the transfer roller 31. Thus, the toner image formed on the photoconductor drum 42 is transferred to the surface of the transfer sheet. The transfer sheet, having the toner image transferred thereto in this fashion, is guided by the post-transfer guide plate 46 to be carried to the fixing roller pair 25. The transfer sheet having the toner image heat-fixed by the fixing roller pair 25 is discharged onto the discharge tray 27 by the discharge roller pair 26.

The developing action of the developing unit 50 will be described.

After the start of operation of the developing unit 50, the developing roller 53, makeup roller 54 and agitating means 55 are rotationally driven by drive means (not shown) in the directions of the arrows. In accordance with the rotation of the agitating member 552 and agitating sheet member 553, constituting the agitating means 55, in the direction of the arrow, the developer accommodated in the agitation chamber 514 is passed over the partition wall 516 while being agitated, whereafter the developer is fed into the development chamber 515 from above the makeup roller 54. On this occasion, the amount of the developer fed into the development chamber 515 is controlled by the regulating portion 571 formed on the inner surface of the closure 57 so that this amount will not be excessive. The developer so supplied by the agitating means 55 is borne on the roller 542 of the makeup roller 54, and carried to the nip between the roller 542 and the roller 532 of the developing roller 53, which is also the developer holding zone 533. The makeup roller 54 and the developing roller 53, as described above, rotate in the same direction, from above to below, in the developer holding zone 533, the nip. Thus, the supply of the developer from the makeup roller 54 to the developing roller 53 is adequate, preventing lack of the developer. Since the makeup roller 54 and the developing roller 53, as described above, rotate in the same direction in the developer holding zone 533, the nip, moreover, they can be driven reliably without requiring a great drive force.

The developer sent to the developer holding zone 533, the nip between the makeup roller 54 and the developing roller 53, is conveyed toward the developer regulating zone 534 while being held on the peripheral surface of the roller 532 constituting the developing roller 53. At this time, the makeup roller 54 and the developing roller 53 rotate in the same direction, from above to below, in the developer holding zone 533, the nip, as described earlier. The developer also passes through the nip, remains held on the developing roller 53, and moves to the developer regulating zone 534 and the developing zone 535. When passing through the nip, the developer is fully rubbed against the makeup roller 54 and the developing roller 53 and fully charged, thus preventing the occurrence of a fog.

In the developer regulating zone 534, the blade 561 of the developer regulating means 56 acts on the developer held on the peripheral surface of the roller 532 of the developing roller 53 to restrict the developer held on the peripheral surface of the roller 532 to a required amount and form it into a thin layer. The developer, which has been regulated by the blade 561 of the developer regulating means 56 in the developer regulating zone 534 and scraped off onto the bottom wall 511 of the development housing 51, does not remain stationary, but is conveyed along the guide surface 516*b* of the partition wall 516, because the makeup roller 54 is rotated in the direction of the arrow.

As described above, the developer is held on the peripheral surface of the roller 532 constituting the developing roller 53 in the developer holding zone 533, and formed into a thin layer by the action of the blade 561 of the developer regulating means 56 in the developer regulating zone 534. Then, this developer is conveyed to the developing zone 535 in accordance with the rotation in the direction of the arrow.

In the developing zone 535, the developer is applied to the latent electrostatic image on the electrostatic photoconductor disposed on the peripheral surface of the photoconductor drum 42, whereby the latent electrostatic image is developed to a toner image. For example, the latent electrostatic image has non-image areas charged to about +600 V, and image areas charged to about +120 V, and a toner as the developer is caused to adhere to the image areas (reversal development). The photoconductor drum 42 and the developing roller 53 are rotationally driven in the directions of the arrows in FIG. 2. In the developing zone 535, therefore, the peripheral surface of the photoconductor drum 42 and the peripheral surface of the roller 532 constituting the developing roller 53 are both moved in the same direction, from below to above.

Experimental Examples will be offered below.

<EXPERIMENTAL EXAMPLES>

Using five kinds of photoconductor drums 42 (diameters 10, 16, 20, 8 and 22 mm), image formation was performed on 500 sheets consecutively. After a 60-minute interval, image formation was performed again on 500 sheets consecutively. This procedure was repeated until a total of 3,000 sheets were printed. The images on the 500th, 1,000th, 1,500th, 2,000th, 2,500th and 3,000th sheets were visually evaluated. The results are shown in Tables 1 to 5. In the tables, (A), (B), (C), (D) and (E) represent the developing roller 53 whose diameter (Y) was set at 80, 90, 100, 110 and 120%, respectively, of the diameter (X) of the photoconductor drum 42. In these experiments, the charging corona dischargers 43 with opening widths of 3.4, 5.5, 6.9, 2.8 and 7.6 mm were used for the 5 kinds of photoconductor drums 42 (diameters 10, 16, 20, 8 and 22 mm), respectively. The image forming machine used in the experiments was a modified form of the LDC-650 (Mita Kogyo Kabushiki Kaisha).

TABLE 1

| | Photoconductor drum, diameter 10 mm (=X) | | | | | | | |
|---|---|---|---|---|---|---|---|---|
| | Developing roller diameter mm (=Y) | Y/X × 100 % | 500th sheet | 1000th sheet | 1500th sheet | 2000th sheet | 2500th sheet | 3000th sheet |
| (A) | 8 | 80 | *1 | *1 | *1,2 | *1,2 | *1,2 | *1,2 |
| (B) | 9 | 90 | ○ | ○ | ○ | ○ | ○ | ○ |
| (C) | 10 | 100 | ○ | ○ | ○ | ○ | ○ | ○ |
| (D) | 11 | 110 | ○ | ○ | ○ | ○ | ○ | ○ |
| (E) | 12 | 120 | ○ | ○ | ○ | ○ | *3 | *3 |

*1: Somewhat blurred image.
*2: Fog caused locally in the drum shaft direction by exposure to ozone.
*3: Fog caused because of a shaved photoconductor.

TABLE 2

| | Photoconductor drum, diameter 16 mm (=X) | | | | | | | |
|---|---|---|---|---|---|---|---|---|
| | Developing roller diameter mm (=Y) | Y/X × 100 % | 500th sheet | 1000th sheet | 1500th sheet | 2000th sheet | 2500th sheet | 3000th sheet |
| (A) | 12.8 | 80 | *2 | *2 | *2 | *2 | *2 | *2 |
| (B) | 14.4 | 90 | ○ | ○ | ○ | ○ | ○ | ○ |
| (C) | 16 | 100 | ○ | ○ | ○ | ○ | ○ | ○ |
| (D) | 17.6 | 110 | ○ | ○ | ○ | ○ | ○ | ○ |
| (E) | 19.2 | 120 | ○ | ○ | ○ | ○ | *3 | *3 |

*2: Fog caused locally in the drum shaft direction by exposure to ozone.
*3: Fog caused because of a shaved photoconductor.

TABLE 3

| | Photoconductor drum, diameter 20 mm (=X) | | | | | | | |
|---|---|---|---|---|---|---|---|---|
| | Developing roller diameter mm (=Y) | Y/X × 100 % | 500th sheet | 1000th sheet | 1500th sheet | 2000th sheet | 2500th sheet | 3000th sheet |
| (A) | 16 | 80 | *2 | *2 | *2 | *2 | *2 | *2 |
| (B) | 18 | 90 | ○ | ○ | ○ | ○ | ○ | ○ |
| (C) | 20 | 100 | ○ | ○ | ○ | ○ | ○ | ○ |
| (D) | 22 | 110 | ○ | ○ | ○ | ○ | ○ | ○ |
| (E) | 24 | 120 | ○ | ○ | ○ | *3 | *3 | *3 |

*2: Fog caused locally in the drum shaft direction by exposure to ozone.
*3: Fog caused because of a shaved photoconductor.

TABLE 4

| | Photoconductor drum, diameter 8 mm (=X) | | | | | | | |
|---|---|---|---|---|---|---|---|---|
| | Developing roller diameter mm (=Y) | Y/X × 100 % | 500th sheet | 1000th sheet | 1500th sheet | 2000th sheet | 2500th sheet | 3000th sheet |
| (A) | 6.4 | 80 | *1 | *1 | *1,2 | *1,2 | *1,2 | *1,2 |
| (B) | 7.2 | 90 | *1 | *1 | *1 | *1 | *1,2 | *1,2 |
| (C) | 8 | 100 | *1 | *1 | *1 | *1 | *1 | *1 |
| (D) | 8.8 | 110 | *1 | *1 | *1 | *1 | *1 | *1 |
| (E) | 9.6 | 120 | *1 | *1 | *1 | *1 | *1,3 | *1,3 |

*1: Somewhat blurred image.
*2: Fog caused locally in the drum shaft direction by exposure to ozone.
*3: Fog caused because of a shaved photoconductor.

TABLE 5

| | Photoconductor drum, diameter 22 mm (=X) | | | | | | | |
|---|---|---|---|---|---|---|---|---|
| | Developing roller diameter mm (=Y) | Y/X × 100 % | 500th sheet | 1000th sheet | 1500th sheet | 2000th sheet | 2500th sheet | 3000th sheet |
| (A) | 17.6 | 80 | *2 | *2 | *2 | *2 | *2 | *2 |
| (B) | 19.8 | 90 | ○ | ○ | ○ | ○ | ○ | ○ |
| (C) | 22 | 100 | ○ | ○ | ○ | ○ | *3 | *3 |
| (D) | 24.2 | 110 | ○ | *3 | *3 | *3 | *3 | *3 |
| (E) | 26.4 | 120 | *3 | *3 | *3 | *3 | *3 | *3 |

*2: Fog caused locally in the drum shaft direction by exposure to ozone.
*3: Fog caused because of a shaved photoconductor.

The problems with the experimental results shown in the tables are discussed below.

Table 1 shows that when the photoconductor drum 42 with a diameter of 10 mm was combined with the developing roller 53 with a diameter of 8 mm (80%), there were a blurred image due to an insufficient nip width, and a fog due to exposure to ozone. The insufficient nip width results in an insufficient development, producing a blurred image. Exposure to ozone deteriorates the photoconductor drum, so that a potential is not increased sufficiently at charging. Since reversal development is adopted, the deteriorated portion easily catches a toner, and causes a fog. In this case, an effective countermeasure is to shave the deteriorated photoconductor moderately to activate it. If the nip width is insufficient, however, a moderate shaving action is not obtained.

The combination with the developing roller 53 with a diameter of 12 mm (120%), on the other hand, brought about a fog due to a shaved photoconductor in 2500th and more sheets. This may have been because the increased diameter of the developing roller 53 gave an increased nip width, thereby increasing the shaving of the photoconductor by the developing roller 53. Thus, the photoconductor may have reached its working limit.

Table 2 shows that when the photoconductor drum 42 with a diameter of 16 mm was combined with the developing roller 53 with a diameter of 12.8 mm (80%), a fog due to exposure to ozone was observed. The reason may be as follows: This combination gives a greater nip width than that obtained by the combination of the photoconductor drum 42 with a diameter of 10 mm and the developing roller 53 with a diameter of 11 mm in Table 1. Thus, it is expected that the shaving action on the photoconductor is fully performed, and the photoconductor can be activated. Actually, however, it is speculated that the deteriorated part of the photoconductor has not been fully activated; that is, the deteriorated part has not been moderately shaved. Normally, when a small-diameter photoconductor drum is used, a charging corona discharger used also has a small opening width (the opening width in the direction of rotation of the photoconductor drum) in agreement with the small diameter. For a large-diameter photoconductor drum, a charging corona discharger with the same opening width may be used, even when the diameter of the drum is somewhat changed. For a small-diameter photoconductor drum, on the other hand, the opening width of the charging corona discharger is large relative to the photoconductor drum, so that the opening width tends to be made small in accordance with the diameter of the photoconductor drum. Thus, the larger the diameter of the photoconductor drum, the wider the range of local deterioration of the photoconductor by exposure to ozone. As the developing roller becomes small in size with respect to the diameter of the photoconductor drum, namely, when the ratio of the nip width to the diameter of the photoconductor drum is low, even a sufficient nip width would not enable the deteriorated part to be shaved effectively.

Table 3 shows that when the photoconductor drum 42 with a diameter of 20 mm was combined with the developing roller 53 with a diameter of 16 mm (80%), a local fog due to exposure to ozone occurred, lowering the image quality.

Its combination with the developing roller 53 with a diameter of 24 mm (120%) caused a fog due to a shaved photoconductor in 2500th and more sheets.

Table 4 shows that when the photoconductor drum 42 with a diameter of 8 mm was combined with the developing roller 53 with any of the diameters, a blur of the image was observed.

Its combination with the developing rollers 53 with diameters of 6.4 mm (80%) and 7.2 mm (90%) caused a fog due to exposure to ozone in addition to a blurred image.

The combination with the developing roller 53 with a diameter of 9.6 mm (120%) caused a fog due to a shaved photoconductor in addition to a blurred image.

Table 5 shows that when the photoconductor drum 42 with a diameter of 22 mm was combined with the developing roller 53 with a diameter of 17.6 mm (80%), a fog due to exposure to ozone was observed.

The combination with the developing rollers 53 with diameters of 22 mm (100%), 24.2 mm (110%) and 26.4 mm (120%) caused a fog due to a shaved photoconductor, lowering the quality of the image.

According to the experimental examples shown in Tables 1, 2 and 3, the combinations of the photoconductor drum 42 and the developing roller 53 having diameters which were 100% and 110% of the diameters of the photoconductor drum 42 gave satisfactory images. However, a shave of the photoconductor occurred when the diameter of the photoconductor drum 42 was 22 mm in the experimental example shown in Table 5. This may have been because the nip width was too large.

The same experiments as described above were conducted using the photoconductor drum 42 having a diameter of 16 mm, with the developing roller 53 being rotated in the same direction as the direction of rotation of the photoconductor drum 42 (the photoconductor drum 42 and the developing roller 53 being moved in reverse directions at the nip).

TABLE 6

| | Photoconductor drum, diameter 16 mm (=X) | | | | | | | |
|---|---|---|---|---|---|---|---|---|
| | Developing roller diameter mm (=Y) | Y/X × 100 % | 500th sheet | 1000th sheet | 1500th sheet | 2000th sheet | 2500th sheet | 3000th sheet |
| (A) | 12.8 | 80 | ○ | ○ | ○ | ○ | ○ | *3 |
| (B) | 14.4 | 90 | ○ | ○ | ○ | ○ | ○ | *3 |
| (C) | 16 | 100 | ○ | ○ | ○ | ○ | ○ | *3 |
| (D) | 17.6 | 110 | ○ | ○ | ○ | ○ | *3 | *3 |
| (E) | 19.2 | 120 | *3 | *3 | *3 | *3 | *3 | *3 |

*3: Fog caused because of a shaved photoconductor.

The combination with the developing roller 53 with a diameter of 19.2 mm (120%) caused a fog due to a shaved photoconductor in 2500th and more sheets. This may have been because the increased nip width increased the shaving of the photoconductor by the developing roller 53, thus bringing the photoconductor to its working limit.

Overall, a fog due to a shaved photoconductor was observed. Furthermore, the combination with the developing roller 53 with a diameter of 12.8 mm did not cause a fog associated with exposure to ozone. These phenomena may have been due to the fact that when the direction of rotation of the developing roller 53 was identical with the direction of rotation of the photoconductor drum 42, the difference in relative speed at the nip between the photoconductor drum 42 and the developing roller 53 was so great that the action of the developing roller 53 to shave the photoconductor drum 53 was too potent.

As described above, when the diameter of the photoconductor drum 42 was set at 10 to 20 mm, and the diameter of the developing roller 53 was set at 90 to 110% of the diameter of the photoconductor drum 42, it was found that a satisfactory image was obtained for 3,000 sheets or more. This may have been because a sufficient nip width was secured, and the ozone-exposed photoconductor drum was shaved in a moderate, tiny amount rather than an excessive amount.

The image forming machine according to the present invention has been described based on the embodiments in which it is applied to a printer. However, the present invention is in no way limited to the illustrated embodiments. The invention is applicable, for instance, to a copier, and various changes or modifications are possible without departing from the scope of the technical concept of the invention.

What we claim is:

1. An image forming machine comprising a single layer dispersion type photoconductor drum disposed rotatably and passing through a charging zone, a latent electrostatic image forming zone, and a developing zone sequentially; a charging device disposed in the charging zone to charge the surface of the photoconductor drum to a specific polarity; and a developing roller disposed in the developing zone to convey a developer to the surface of the photoconductor drum having a latent electrostatic image formed in the latent electrostatic image forming zone; wherein the photoconductor drum and the developing roller contact each other at their surfaces and to be rotationally driven in reverse directions; and the photoconductor drum has a diameter set at 10 to 20 mm, while the developing roller has a diameter set at 90 to 110% of the diameter of the photoconductor drum.

* * * * *